US005240443A

United States Patent [19]

Futaki

[11] Patent Number: 5,240,443

[45] Date of Patent: Aug. 31, 1993

[54] JET PROPELLED BOAT

[75] Inventor: Yoshiki Futaki, Iwata, Japan

[73] Assignee: Yamaha Hatsudoki Kabushiki Kaisha, Iwata, Japan

[21] Appl. No.: 912,885

[22] Filed: Jul. 13, 1992

Related U.S. Application Data

[63] Continuation-in-part of Ser. No. 830,732, Feb. 4, 1992, U.S. Pat. No. 5,224,887.

[30] Foreign Application Priority Data

Feb. 8, 1991 [JP] Japan ..... 3-17486
Jul. 15, 1991 [JP] Japan ..... 3-173923

[51] Int. Cl.[5] ..... B63H 11/00
[52] U.S. Cl. ..... 440/38; 114/270
[58] Field of Search ..... 440/1, 2, 38–42, 440/47, 54, 76, 77; 114/270; 180/286; 248/101

[56] References Cited

U.S. PATENT DOCUMENTS 1,893,406 1/1933 Geraghty ..... 180/286
4,934,969 6/1990 Kuragaki ..... 440/1
5,088,667 2/1992 Olson ..... 248/101

FOREIGN PATENT DOCUMENTS 319793 1/1989 Japan .
0014789 1/1991 Japan ..... 440/46

*Primary Examiner*—Edwin L. Swinehart
*Attorney, Agent, or Firm*—Ernest A. Beutler

[57] ABSTRACT

Several embodiments of jet propelled watercraft wherein the jet propulsion unit has a water inlet opening forming portion that is movable between a driving position in which water may be drawn through the opening and a service position wherein the opening may be accessed for servicing. A screen is fixed relative to the water inlet opening of the jet propulsion unit and cooperates with a corresponding opening in the hull to force all water entering the water inlet opening to pass through the screen when the jet propulsion unit is in its driving position. However, the screen is spaced from the water inlet opening forming portion of the jet propulsion unit in its service position so as to permit servicing of the jet propulsion unit water inlet opening without removal of the screen. A variety of interlock arrangements are disclosed so as to preclude driving of the jet propulsion unit when it is not in its driving position. A litter bag is also supported within a tunnel in which the jet propulsion unit is contained for receiving foreign articles so that they do not have to be discharged back into the body of water in which the watercraft is operating. In addition, a liquid tank for the engine is positioned within and protected by a flotation device through which certain control components for the watercraft also extend.

35 Claims, 12 Drawing Sheets

JET PROPELLED BOAT

CROSS-REFERENCE TO RELATED APPLICATION

This application is a continuation-in-part of my application entitled, "Screen for Watercraft Jet Propulsion Unit", Ser. No. 830,732, filed Feb. 4, 1992, now U.S. Pat. No. 5,224,887 and assigned to the Assignee hereof.

BACKGROUND OF THE INVENTION

This invention relates to a jet propelled boat and more particularly to an improved water inlet screen arrangement for the jet propulsion unit of such a boat, an improved operating and drive arrangement therefor, an improved cleaning arrangement for the inlet screen of such a watercraft and an improved arrangement for mounting a liquid tank in such a watercraft.

As noted in my aforenoted co-pending application, it is desirable in conjunction with jet propelled watercraft to provide an arrangement wherein the water inlet opening of the jet propulsion unit may be accessed for service. The arrangement shown in that application permits the jet propulsion unit water inlet portion to be raised to an out-of-the-water service position and a screen, which removes large foreign objects from the ingested water, can be moved so that an operator may place his hand into the water inlet opening to remove entrained material of a nature which cannot easily be removed from the ingested water by the inlet screen. Although the arrangement shown in that application is particularly advantageous, that arrangement necessitates the mounting of the screen across the water inlet opening of the jet propulsion unit for movement between its normal screening position and an opened service position. This complicates the structure and requires some form of arrangement, as shown therein, for holding the screen in its operative position when the jet propulsion unit is employed to drive the watercraft.

It is, therefore, a principal object of this invention to provide an improved water inlet screen arrangement for a jet propulsion unit which will effectively screen foreign objects from the water passing into the water inlet opening but which is supported in such a way that the water inlet opening may be accessed without necessitating movement of the screen when the jet propulsion unit is in a non-driving position.

In addition to the construction shown in the aforenoted co-pending application, a number of types of jet propulsion units have been proposed wherein at least the water inlet opening portion may be moved from a normal driving position to a service position. In this service position, an operator may desire to place his hand into the water inlet opening for various servicing functions. However, if the jet propulsion unit is inadvertently powered at this time, there are obvious dangers.

It is, therefore, a further object of this invention to provide an improved arrangement for a water jet propulsion unit that is movable between a driving position and a service position and wherein it is ensured that the jet propulsion unit cannot be driven when in its service position.

It has been proposed to provide the control mechanism for the power device that moves the jet propulsion unit water inlet opening between its positions within a tunnel in the watercraft in which the jet propulsion unit is positioned. This will ensure against inadvertent operation of this power means. However, there are some instances wherein it may be desirable to provide a remote control for the power means. When this is done, it is desirable to ensure that the remote operator cannot cause an operation that could injure an operator servicing the jet propulsion unit adjacent the tunnel.

It is, therefore, a still further object of this invention to provide an improved control arrangement for a jet propulsion unit.

It is another object of this invention to provide a control arrangement for a jet propulsion unit wherein there is a remote operator for the power unit and wherein that remote operator is disabled in the event an operator is servicing the unit.

In many watercraft of the type which have jet propulsion units that are mounted so that the water inlet opening can be moved between a drive position and a service position, the jet propulsion unit, or at least the water inlet portion of it, is mounted within a tunnel on the underside of the hull of the watercraft. Such a mounting arrangement gives a neat and smooth appearance to the watercraft. Where this is done and the water inlet opening is serviced from an access hatch in the tunnel, a problem arises with respect to the disposal of foreign material that is removed from the water inlet opening of the jet propulsion unit. If this foreign material is dumped back into the body of water in which the watercraft is operating, then a pollution problem can occur. On the other hand, if the operator places this foreign material inside of the hull of the watercraft, then an unsightly appearance arises.

It is, therefore, a still further object of this invention to provide an improved jet propulsion unit for a watercraft wherein the watercraft is provided with a disposal device in the tunnel in which the jet propulsion unit water inlet opening is positioned.

In watercraft of this type, it is frequently the practice to employ one or more liquid tanks in the hull of the watercraft which supply liquid to the propulsion unit for its operation. For example, it is frequently the practice to position a fuel tank within the hull for supplying fuel to the powering internal combustion engine. However, when this is done the fuel tank should be mounted in such a way that it can be protected.

It is, therefore, a still further object of this invention to provide an improved tank mounting arrangement for a hull wherein the tank is protected and the protection device also provides added buoyancy for the watercraft.

SUMMARY OF THE INVENTION

A first feature of this invention is adapted to be embodied in a jet propelled watercraft having a hull that defines a water inlet. A jet propulsion unit is provided that has portion forming a water inlet opening through which water is drawn for propelling the watercraft. Means support the water inlet opening forming portion for movement between a driving position in which the water inlet opening is in registry with the hull water inlet and a service position. A screen is fixed contiguous to the jet propulsion unit water inlet opening at least when the water inlet opening is in its driving position. The hull opening, screen and water inlet opening cooperate for precluding the flow of water into the jet propulsion unit water inlet opening without passing through the screen when the water inlet opening is in its driving position and for permitting the water inlet opening to be accessed without movement of the screen when the water inlet opening is in its service position.

Another feature of the invention is adapted to be embodied in a jet propelled watercraft having a hull containing an internal combustion engine. A jet propulsion unit having a portion forming a water inlet opening through which water is drawn for propelling the watercraft is driven by the internal combustion engine. Means support the water inlet opening forming portion for movement between a driving position in which the water inlet opening can draw water from the body of water and a service position. Power means are provided for operating the water inlet opening forming position between its positions. In accordance with this feature of the invention, control means disable the operation of the internal combustion engine when the power means is operated for operating the water inlet opening forming portion between its positions.

A further feature of this invention is adapted to be embodied in a jet propelled watercraft having a hull defining a tunnel at the rear end thereof. A jet propulsion unit has a portion forming a water inlet opening through which water is drawn for propelling the watercraft and which jet propulsion unit is mounted at least in part within the tunnel. Means are provided for supporting the water inlet opening forming portion for movement between a driving position in which the water inlet opening is adapted to draw water from the body of water in which the watercraft is operating and a service position. The hull is formed with an access opening that accesses the interior of the tunnel for servicing the water inlet opening when in its service position. In accordance with this feature of the invention, means are provided within the tunnel for supporting a container for receiving foreign objects removed from the water inlet opening of the jet propulsion unit.

Another feature of the invention is adapted to be embodied in a watercraft powered by an internal combustion engine contained within a hull. A liquid tank containing a liquid for engine operation is positioned within the hull. In accordance with this feature of the invention, buoyant means are interposed between the hull and the liquid tank for adding buoyancy to the hull and for protecting the liquid tank.

DETAILED DESCRIPTION OF THE PREFERRED EMBODIMENTS OF THE INVENTION

Figure 1:
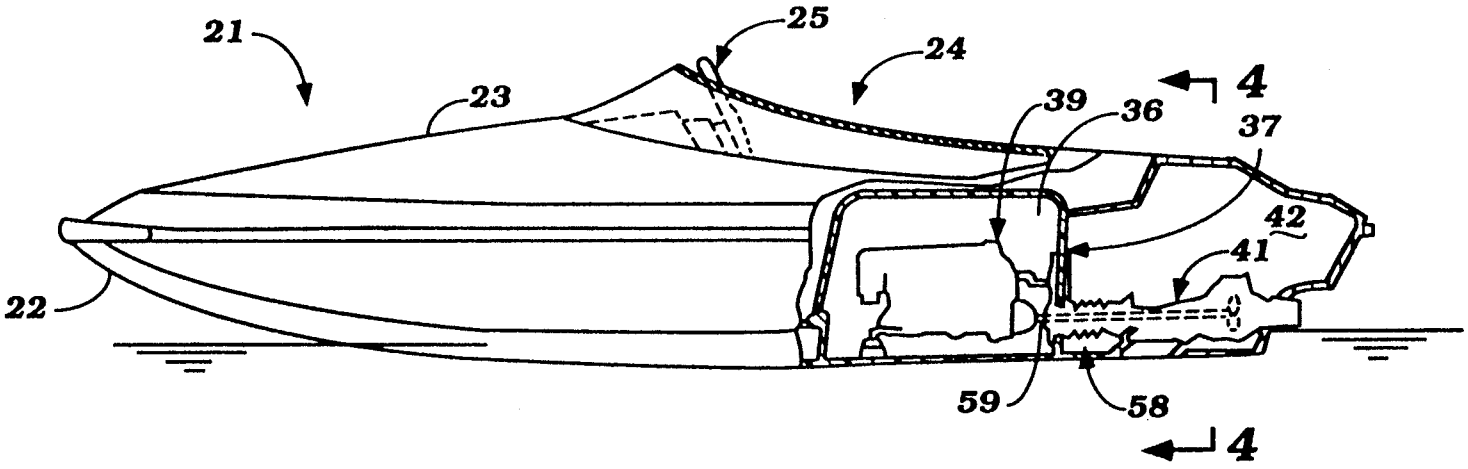
FIG. 1 is a side elevational view of a watercraft constructed in accordance with an embodiment of the invention, with portions broken away and shown in cross section.
Figure 8:
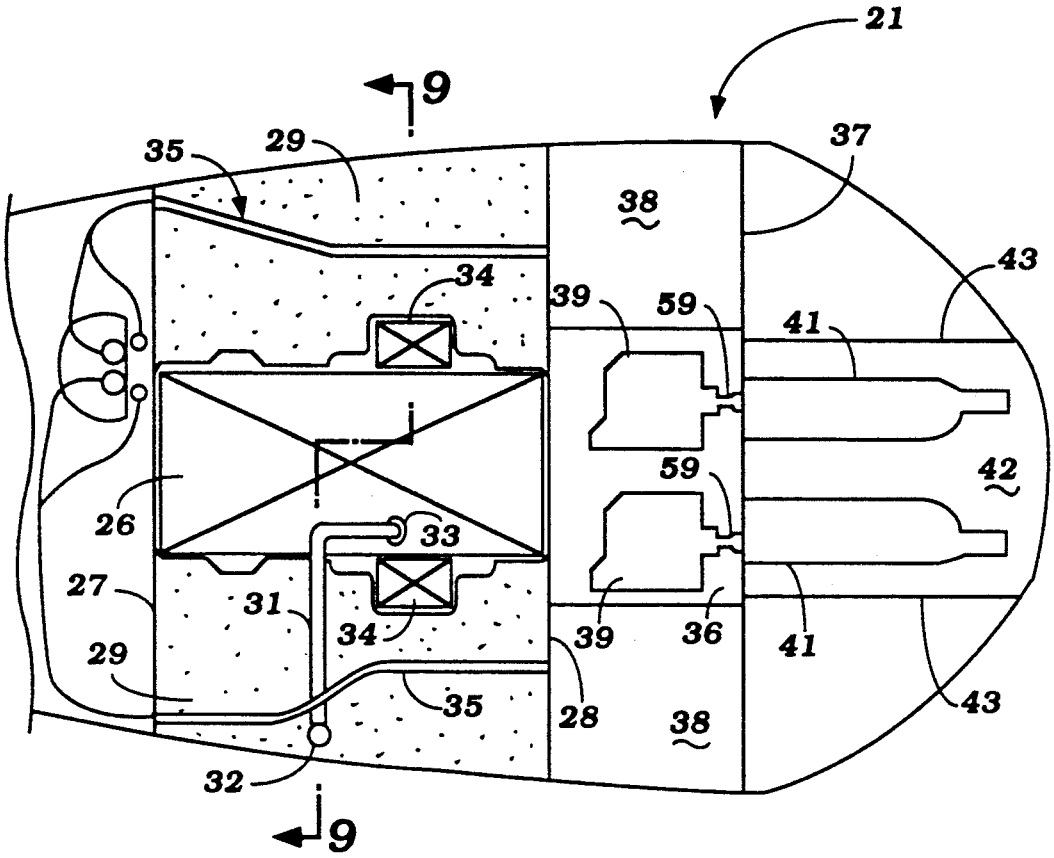
FIG. 8 is a cross-sectional top plan view of the rearward portion of the watercraft.
Figure 9:
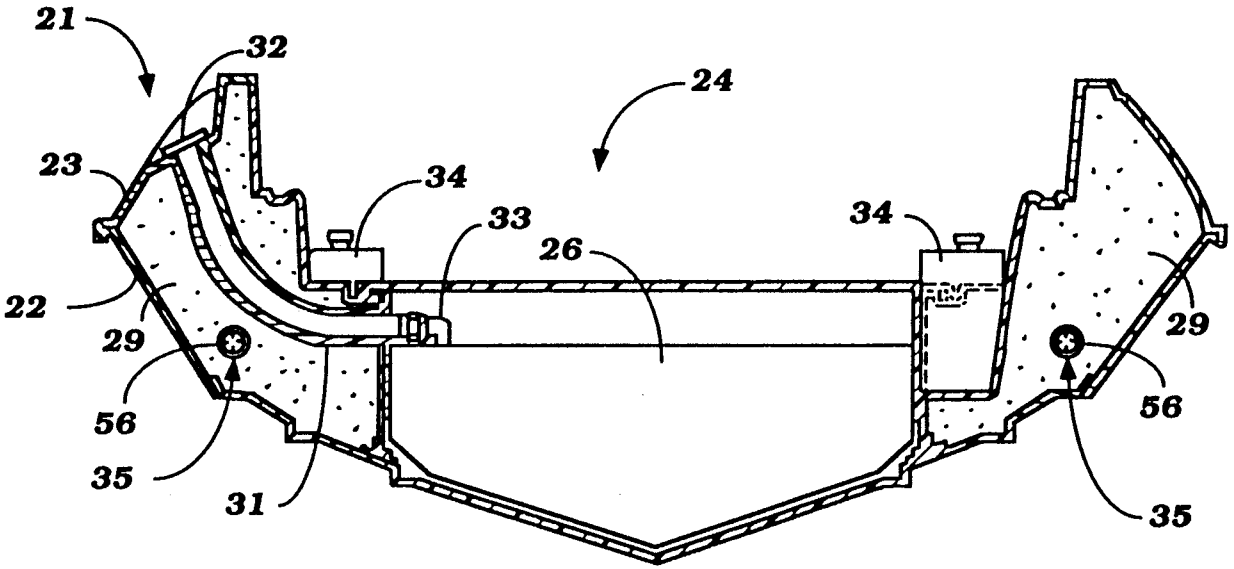
FIG. 9 is a cross-sectional view taken along the line 9—9 of FIG. 8.

Referring first in detail to FIGS. 1, 8 and 9, a watercraft constructed in accordance with an embodiment of the invention is identified generally by the reference numeral 21. The watercraft 21 is made up of a hull comprised of a lower hull part 22 and an upper deck part 23 which may be formed from suitable materials such as fiberglass reinforced resins or the like and which are secured to each other in a suitable manner. The deck portion 23 forms a cockpit or riders' area, indicated generally by the reference numeral 24, in which a plurality of seats (not shown) are provided to seat a number of passengers and an operator in any known fashion. Controls for the watercraft including a steering wheel 25 are positioned in the riders' area 24 forwardly of the operator's seat.

Positioned beneath the riders' area 24 is a main fuel tank 26 which is disposed between a forward bulkhead 27 and rear bulkhead 28. The fuel tank 26 is also spaced inwardly from the sides of the hull portion 22 and deck portion 23 and these areas are filled with a foamed flotational material 29 such as any of the known flotation materials normally used in this art. Because of this positioning, the fuel tank 26 is protected on the sides by the flotation material 29.

A fill pipe 31 is embedded in one of the sides of the flotation material and has a fill neck 32 that is exposed at this side of the watercraft for filling of the tank 31 through a filling neck 33. A pair of oil tanks 34 are disposed on the opposite sides of the fuel tank 26 and are in part encircled by the foam material 29 so that these tanks will also be protected. A pair of conduit 35 are embedded in the foam material 29 and A pair of conduits 35 are embedded in the foam material 29 and extend through the fore and aft bulkheads 27 and 28 so as to pass certain controls, as will be hereinafter described.

The foam material 29 may be foamed directly in place to the hull and deck sections 22 and 23, respectively, and also may be foamed in place on the front and rear bulkheads 27 and 28. Alternatively, separate plate materials may be secured to the foam 29 and then these plates affixed to the hull and bulkheads of the watercraft.

An engine compartment, indicated generally by the reference numeral 36 is positioned to rear of the bulkhead 28 and bounded by this bulkhead at its front. A further rear bulkhead 37 extends across the engine compartment 36 and to the sides of the watercraft. Water tight compartments 38 are formed within the hull outwardly of the engine compartment 36 and may house appropriate auxiliaries for the watercraft.

In the illustrated embodiment, the watercraft 21 is powered by a pair of propulsion devices, although it should be readily apparent to those skilled in the art that many facets of the invention can be employed with a single propulsion device. These propulsion devices include internal combustion engines 39 mounted within the engine compartment 36 and which drive, in a manner to be described, jet propulsion units 41 positioned within a tunnel 42 formed at the rear of the watercraft 21 by the bulkhead 37 and by pairs of side bulkheads 43.

The jet propulsion units 41 have a construction as may be best understood by reference to FIGS. 2-7. Construction of the jet propulsion units 41 is basically as described in the co-pending application of Hirofumi Imaeda and the inventor hereof, entitled "Removable Jet Propulsion Unit for Watercraft", Ser. No. 731,583, filed Jul. 17, 1991 and assigned to the Assignee hereof. That disclosure is incorporated herein by reference and reference may be had to that application for the construction of any components which are not described herein. Basically, however, the invention deals with the water inlet arrangement for the jet propulsion unit and other external details so that it is not really necessary for one skilled in the art to understand the internal construction of the jet propulsion unit, except as will hereinafter be described.

The jet propulsion units 41 each include water inlet housing portions 44 having a downwardly facing water inlet opening 45 which communicates with a water inlet channel 46 through which water may be drawn from the body of water in which the watercraft is operating, in a manner to be described. This water is drawn by an impeller (not shown) that is contained within an impeller housing 47 and mounted on an impeller shaft 48 which is driven in a manner which will be described. The impeller housing 47 and water inlet housing 44 are fixed to each other and are rotatably journaled in a suitable supporting assembly as described in the aforenoted patent application Ser. No. 731,538.

This supporting assembly has affixed to it a discharge nozzle portion 49 upon which a steering nozzle 51 is supported for pivotal movement about a vertically extending steering axis defined by pivot pins 52. Bowden wires 50 are connected to the steering nozzle 51 and extend forwardly, in part through the conduits 35, to the steering wheel 25 for steering of the watercraft 21. A reverse thrust bucket assembly 53 is mounted on the steering nozzle 51 for pivotal movement about a pivot axis 54 for effecting reverse thrust of the watercraft. A fixed reverse thrust gate 55 is also fixed to the steering nozzle 51 so as to assist in this reverse thrust action. This reverse thrust bucket assembly and its operation may have a construction as described in the co-pending application of Yoshiyuki Kaneko, entitled "Reverse Thrust Bucket for Jet Drive", Ser. No. 909,621, filed Jul. 7, 1992 and assigned to the Assignee hereof. A Bowden wire actuator 56 is connected to the reverse thrust bucket 53 for operating it in a known manner. The Bowden wire actuator 56 may be another of the components which pass through the conduits 35 as shown in FIG. 9.

A hydraulically operated motor 57 is mounted on the mounting bracket which fixedly supports the discharge nozzle 49 and drives a ring gear fixed to the impeller housing 47 for rotating the impeller housing 47 and water inlet housing 44 as described in the aforenoted co-pending application Ser. No. 731,538.

The impeller shaft 48 extends forwardly through a pilot portion 57 of the water inlet housing portion 44 and is coupled by means of a universal joint (not shown) enclosed within a flexible boot 58 to an output shaft 59 of the engine 39. This universal joint accommodates not only the rotary movement of the impeller housing 47 and water inlet housing 44 about the axis of the impeller shaft 48 but also pivotal movement about a transversely extending axis, as will now be described.

Each jet propulsion unit 41 is supported within the tunnel 42 on a respective combined cradle and water inlet opening forming assembly, indicated generally by the reference numeral 61. The assembly 61 is comprised of a lower plate 62 that has a flange portion which overlies and is affixed to an opening formed in the lower portion of the hull 22. As may be best seen in FIG. 4, the hull 22 has a V-bottom and these plates 62 lie in parallel relationship to the V surface of the plate. The plates 62 have affixed to them side members 63 having upwardly extending arm portions 64. These arm portions 64 receive a pivot pin 65 which pivotally journals one end of a pair of support arms 66. The support arms 66 extend rearwardly and are connected to the non-rotating support of the impeller portion 47 and water inlet portion 44. This is also fixed relative to the discharge nozzle 49, as afore described. As a result, the support arm 66 pivotally support the jet propulsion unit 41 for movement about a pivot axis defined by the pin 65, which is, in turn, aligned with the universal joint contained within the flexible boot 58. A pair of stops 70 (FIG. 2) are carried by the plate 62 and engage the arms 66 to add in the support of the jet propulsion unit 41 when in its driving position.

Hydraulically actuated cylinder assemblies 67 have their piston rods 68 pivotally connected to the upper ends of the arms 64 by means pivot bolts 69. The cylinder portion of the assemblies 67 are formed with trunnions 71 that are pivotally connected to the support arms 66 and fixed support for the jet propulsion unit 41 by upstanding brackets 72 and pivot pins 73. When the cylinders 67 are expanded and contracted, the jet propulsion unit 41 will be moved between its lowered drive position as shown in solid line views in FIG. 4 and a raised service position as shown in phantom lines. The structure by which this motion is accomplished will be described later.

The way in which the water inlet portion 44 of the jet propulsion unit 41 cooperates with the support cradle and water inlet forming portion 61 will now be described by particular reference to FIGS. 5-7. It should be noted that a water inlet 74 is affixed to the plate 62 and forms a downwardly facing water inlet opening 75 through which water may be drawn. There is an upstanding portion that defines a continuation of this water inlet opening 75 and which terminates in an angularly disposed upper surface 76. A plate 77 having an opening 78 is affixed to this flange by fasteners 79. A seal 80 is carried by the water inlet opening portion 45 of the jet propulsion unit water inlet portion 44 so that when the jet propulsion unit 41 is in its lowered operative position, there will be good water seal between the opening 75 of the assembly 61 and the opening 45 of the jet propulsion unit so as to ensure good efficiency.

In order to prevent the ingestion of large foreign objects, a screen assembly, indicated generally by the reference numeral 81, is provided across the mouth of the water inlet opening 45 of the jet propulsion unit 41. This screen assembly 81 is constructed in such a way that an operator may reach in and clean foreign material from the water inlet opening 45 of the water inlet portion 44 without necessitating removal of the screen 81 when the unit 41 is in its service position as clearly shown in FIG. 5 while, at the same time, maintaining a flow pattern in which any water passing to the jet propulsion unit water inlet opening 45 must pass through the screen 81 when in the driving position.

Figure 5:
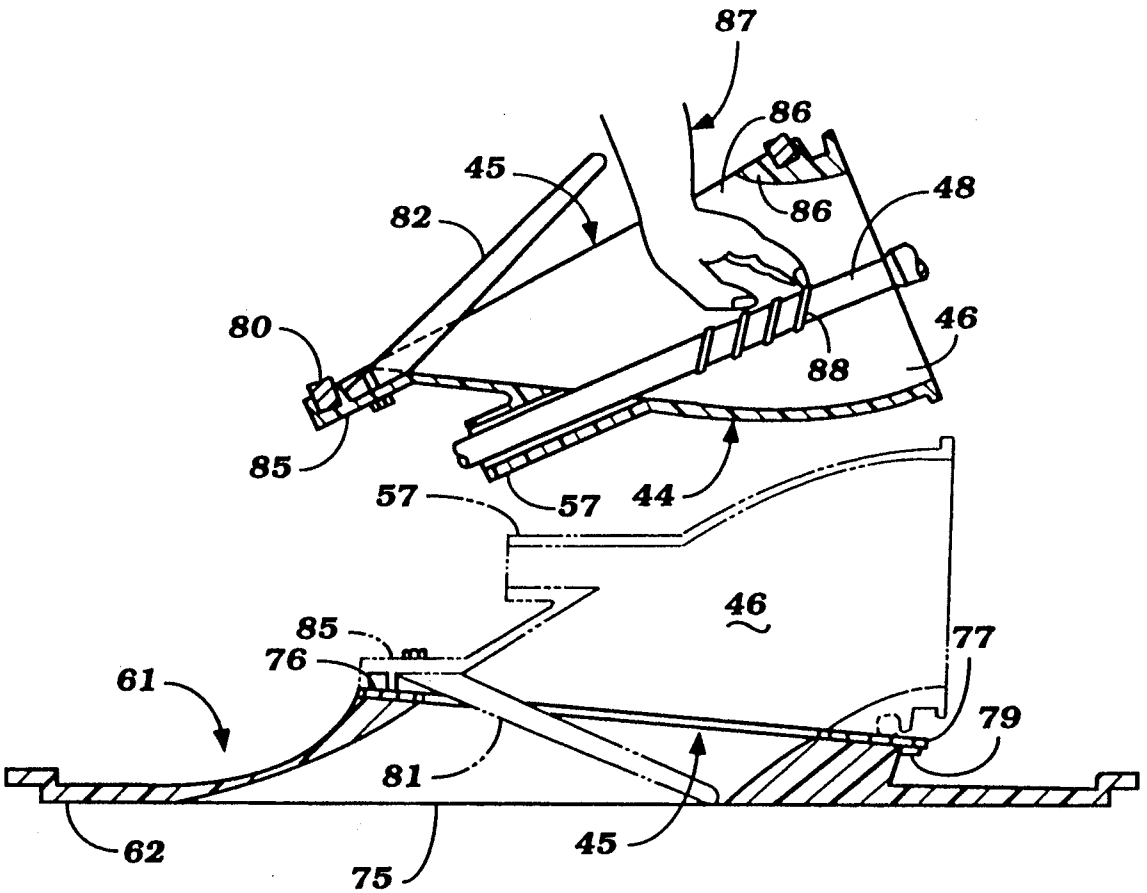
FIG. 5 is a side elevational view, with portions broken away and shown in cross section, of the area shown in FIG. 2 and illustrates how foreign materials can be removed from the jet propulsion unit.
Figure 6:
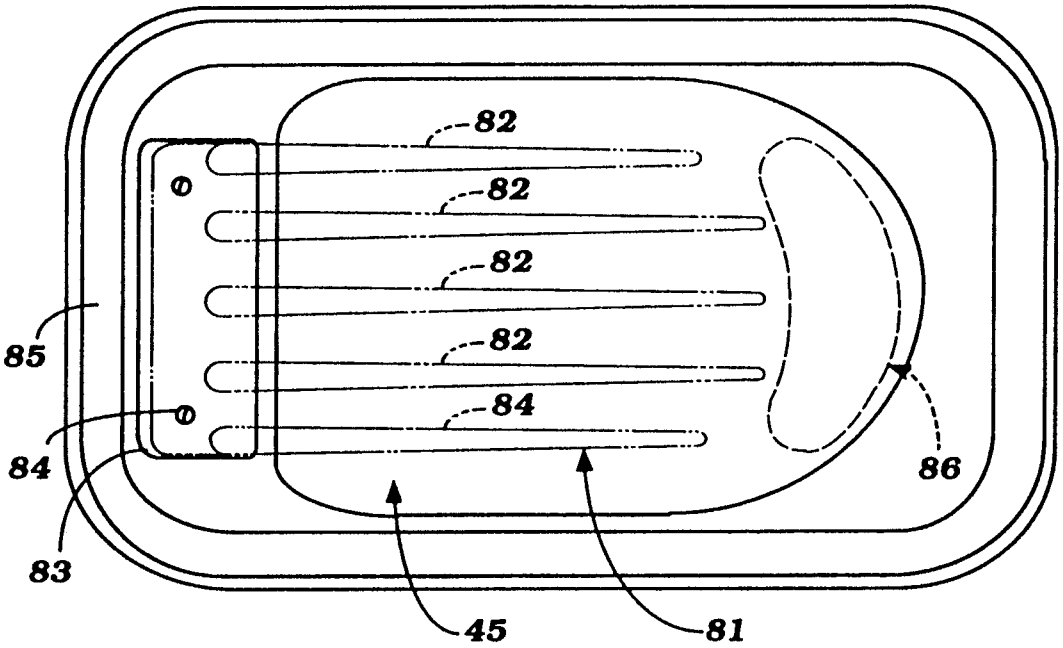
FIG. 6 is a view taken generally along a plane parallel to the water inlet opening of the jet propulsion unit showing the manner in which the screen members are mounted and the relationship to the openings in the mounting cradle and the jet propulsion unit.
Figure 7:
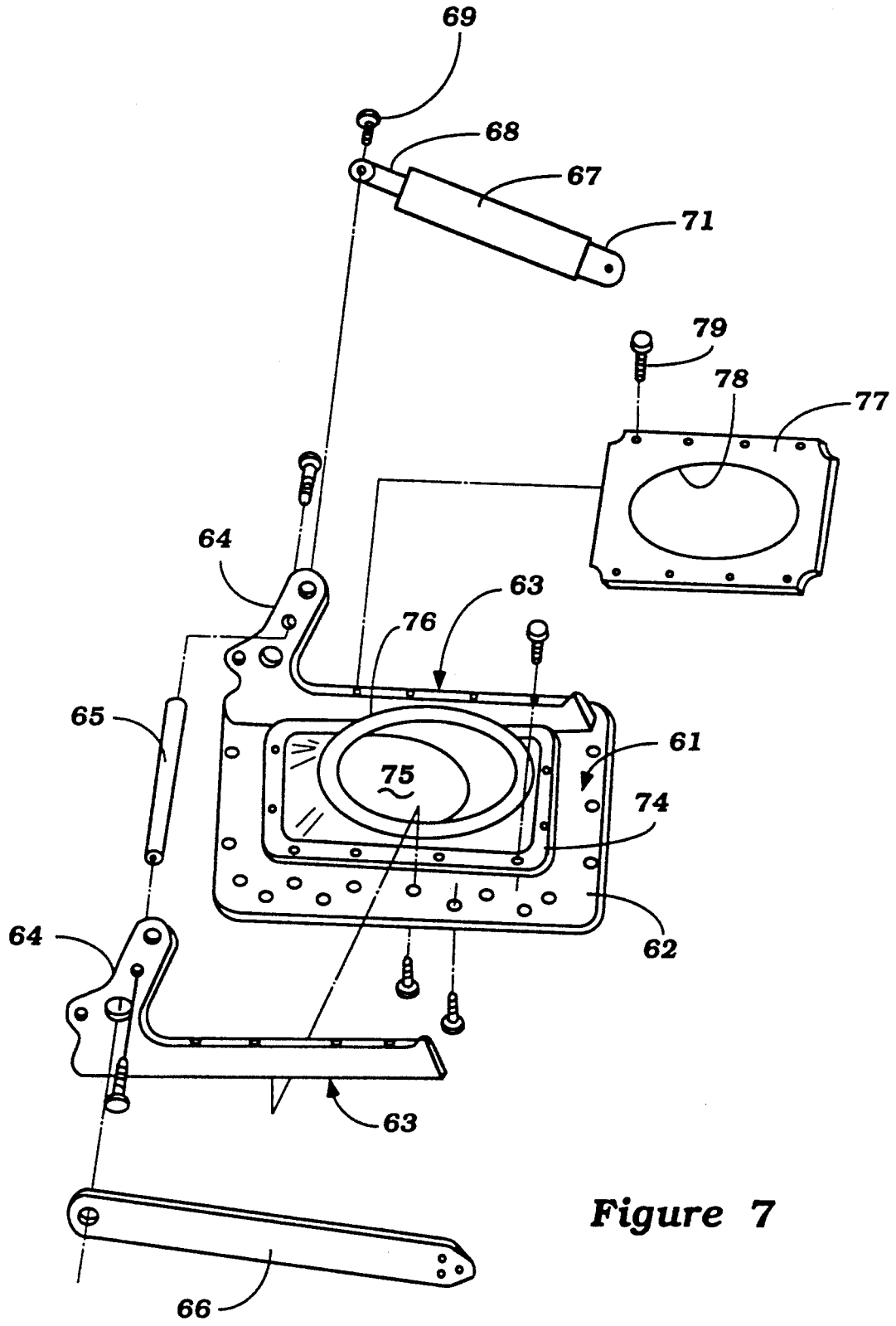
FIG. 7 is a partially exploded view showing how the jet propulsion unit is mounted on the lower cradle plate and specifically how the cradle plate is related to the water inlet opening of the jet propulsion unit.

As may be readily seen in FIG. 6, the screen 81 is comprised of a plurality of rod-like members 82 which extend from one peripheral edge of the water inlet opening portion 44 where they are affixed by means of a plate 83 and fasteners 84 to a flange 85 which is formed around the water inlet opening 45 of the jet propulsion unit 41. Thus, in the operative or drive position as shown in phantom in FIG. 5, the rod-like members 85 extend closely adjacent the assembly 61 and specifically its opening 75 so as to provide and effective screen through which all water entering the jet propulsion unit must pass.

However, when the unit is raised and rotated to the position shown in FIG. 5, as will be described, there is an adequate clearance area indicated by the area 86 which permits an operator's hand 87 to be passed in so as to remove seaweed 88 or like material which may escape past the screen 81. It should be noted that it is not effective to have the screen exclude all foreign material since this would restrict the flow of water to the jet propulsion unit 41 for its operation. However, it is important to remove large and rigid objects which might damage the internal components of the jet propulsion unit such as the impeller.

The arrangement by which the jet propulsion unit 41 is moved between its raised and lowered position will now be described by particular reference to FIG. 10. It had been previously noted that the water inlet opening portion 41 and impeller portion 47 of the jet propulsion unit 41 are supported for rotation about the axis of the impeller shaft 48 and a hydraulic drive motor was provided for achieving that rotation. This hydraulic drive motor is indicated at 89 in FIG. 10. It should be noted that the hydraulic motor 89 or the jet propulsion unit 41 is provided with stops that limit the downward rotation to the position shown in solid lines in FIGS. 1 and 2 and in phantom lines in FIG. 5 and in its upwardly facing service position as shown in phantom lines in FIG. 2 and in solid lines in FIG. 5.

Figure 10:
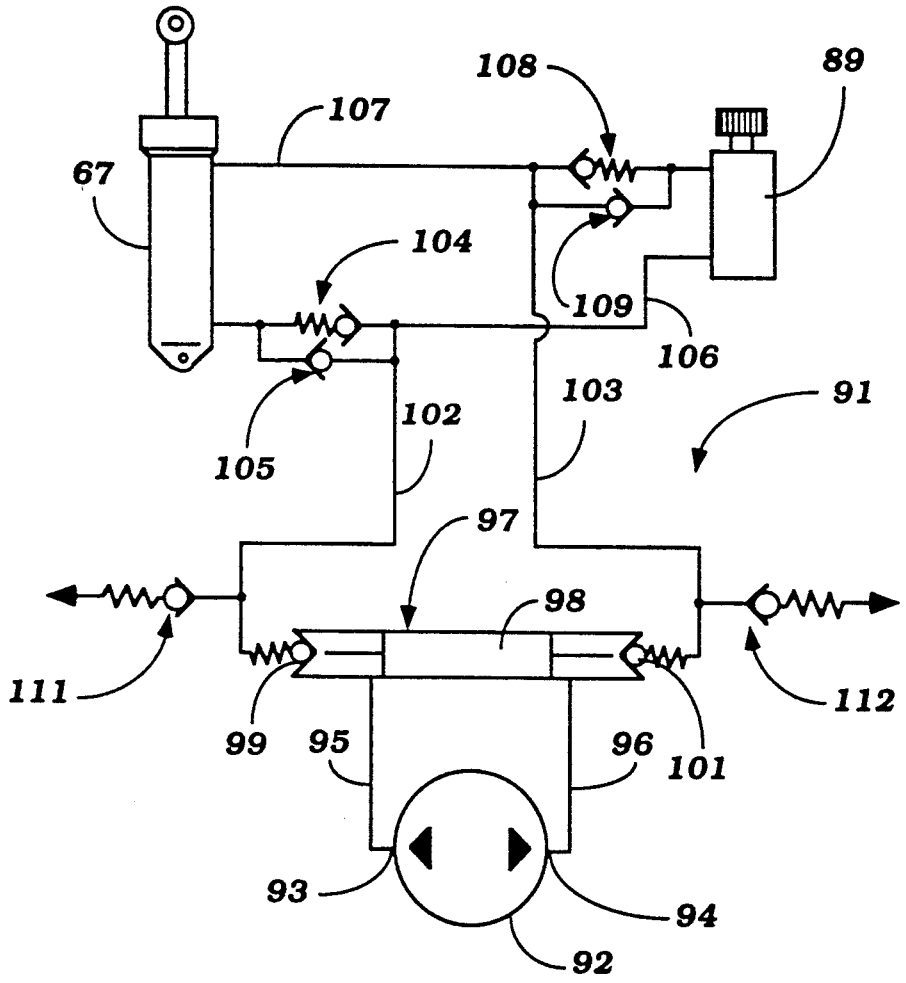
FIG. 10 is a partially schematic view showing the hydraulic control circuit in accordance with one embodiment of the invention.

The operating system, indicated generally by the reference numeral 91 in FIG. 10, includes a reversible hydraulic pump 92 that is driven by a reversible electric motor. The pump 92 has a pair of ports 93 and 94, each of which communicates with a respective conduit 95 and 96. These conduits 95 and 96 extend to opposite sides of a shuttle valve assembly 97 in which a shuttle piston 98 is slidably supported. First and second check valve assemblies 99 and 101 are positioned at the opposite ends of the shuttle valve assembly 97 and are adapted to be opened by pressure to permit flow to respective lines 102 or 103. Alternatively, the shuttle piston 98 may unseat the check valves 99 or 101, as is well known in this art.

The line 102 extends to the down side chamber of the hydraulic cylinders 67 and a pressure responsive valve 104 and a light check valve 105, which are oppositely acting, communicate the line 102 to this chamber of the fluid motors 67. In addition, a line 106 connects the line 102 with the rotate-down side of the fluid motor 89.

Line 103 intersects a line 107 that extends to the tilt-up chamber of the fluid motors 67. This line 107 also communicates with the rotate-up side of the fluid motor 89 through a double acting check valve assembly including a pressure responsive valve 108 which permits flow from the line 107 to this side of the fluid motor 89 and a lightly operating check valve 109 that permits flow in the opposite direction.

A pair of pressure responsive valves 111 and 112 are provided in the lines 102 and 103 for pressure relief. In addition, the valves 111 and 112 may be provided with electrical switches which provide an electrical signal when they are activated so as to deactivate the electric motor that drives the pump 92.

The operational mode will now be described by reference to FIG. 10 with cross reference being made to FIGS. 2 and 5 to illustrate how the operation of the circuit of FIG. 10 achieves the movement of the jet propulsion unit 41 and the purposes of this operation. As may be noted in FIG. 2, the hull deck portion 23 is provided with an access opening 113 that is disposed above the tunnel 42 and through which the jet propulsion units and specifically their water inlet openings 45 may be accessed. A control switch assembly 114 is provided in the tunnel 41 in proximity to the opening 11 which is normally closed by a removable or pivoted hatch cover 115.

The control switch assembly 114 includes a pair of kill switches 116, each for a respective one of the internal combustion engines 39, and a pair of switches 117 which control the electric motors associated with the hydraulic pumps 92 of the respective jet propulsion units 41. It is important to ensure that the jet propulsion units 41 are not rotated to their service positions as shown in phantom in FIG. 2 and in solid in FIG. 5 unless the driving engines 39 are disabled. Therefore, there is provided an electrical interlock wherein the switches 116 cannot cause operation of the pumps 92 except when the kill switches 117 are in their "on" or engine stopping positions.

Assuming that this is the case, operation of the switch 116 will cause the electric motor associated with the hydraulic pump 92 to drive the pump in a tilt and rotate-up direction under which the port 94 is pressurized and the port 93 functions as a return port. Although not shown, it is to be understood that the ports 93 and 94 also communicate through check valve passageways with a hydraulic reservoir so that pressure relief can occur and also so that makeup fluid may be drawn, where necessary.

Figure 2:
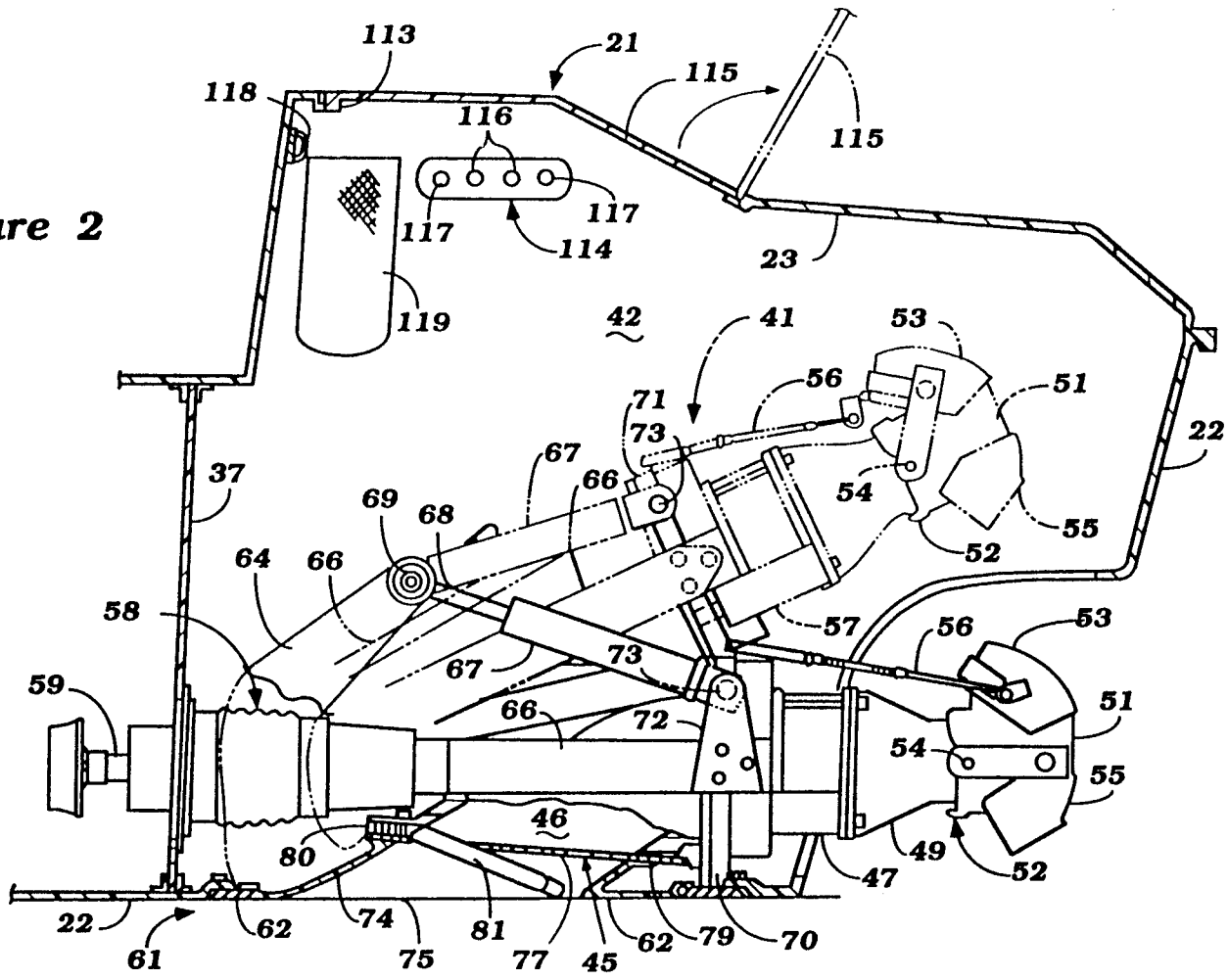
FIG. 2 is an enlarged side elevational view of the broken away portion of FIG. 1.
Figure 3:
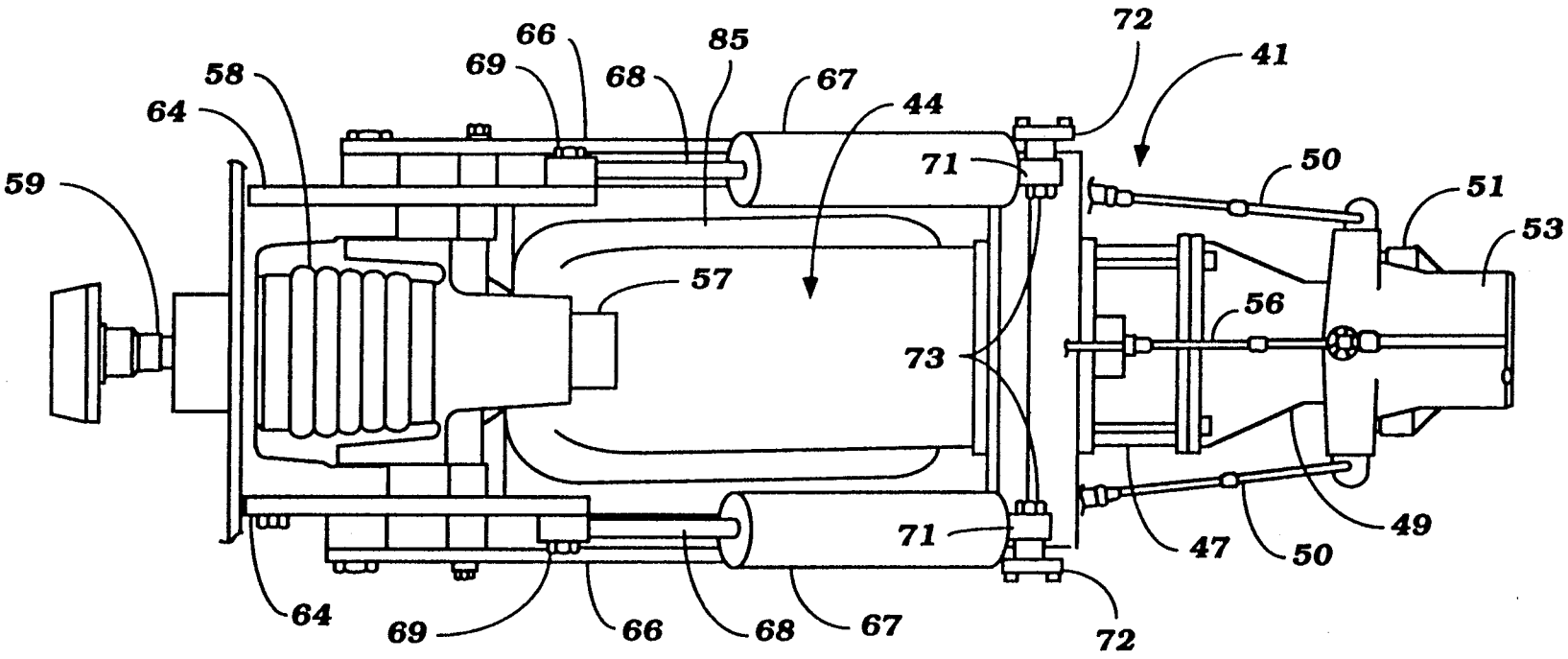
FIG. 3 is a top plan view of the area shown in FIG. 1 and particularly showing the jet propulsion unit.
Figure 4:
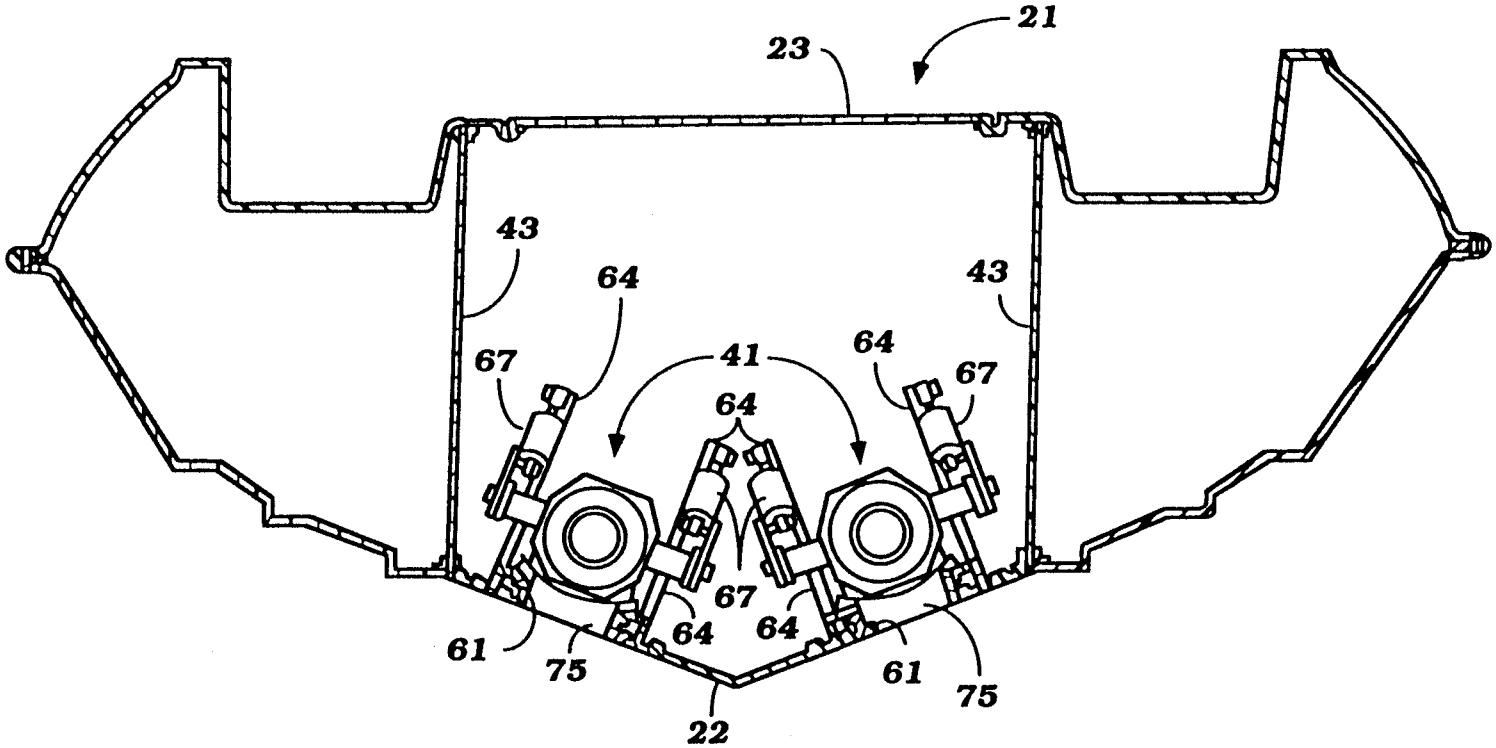
FIG. 4 is an enlarged cross-sectional view taken generally along the line 4—4 of FIG. 1.

When the port 94 is pressurized, the conduit 96 will be pressurized and urge the shuttle piston 98 to the left as shown in FIG. 2. The pressure acting on the check valve 101 will unseat it and cause the line 103 to be pressurized. When the line 103 is pressurized, the line 107 will also be pressurized and pressure will be exerted on the fluid motor 67 to tend to cause the piston rod 68 to be driven inwardly and pivot the jet propulsion unit 41 to its upper position. When this occurs, the pressure responsive valve 108, which opens at a relatively high pressure, will be held closed and all of the hydraulic fluid will be delivered to the fluid motor 67.

This will cause fluid to be expelled from the opposite side of the fluid motor 67 through the line 102 and lightly opening check valve 105. The leftward movement of the shuttle piston 98 will unseat the check valve 99 and this fluid then flows back through the line 95 to the port 93 of the pump 92 which acts as a return port.

It should be noted that it is desirable to have the jet propulsion unit 41 pivot upwardly before it rotates so that the seal 80 between the water inlet opening portion 44 of the jet propulsion unit 41 and the plate 77 can be relieved of sealing pressure and will not be damaged by rotary motion.

This tilt-up operation continues until the fluid motors 67 reach the ends of their stroke and the jet propulsion unit 41 is pivoted about the pivot axes 65 to the raised position shown in phantom in FIG. 2 and in solid lines in FIG. 5. At this time, however, no rotation of the water inlet opening 45 will have occurred.

It should also be noted that the shape of the water inlet opening 75 of the assembly 61 is curved so that the screen members 81 may move freely relative to this opening without any interference during this tilting operation.

Once the jet propulsion unit 41 is totally pivoted up, a pressure will rise in the line 107 due to the bottoming out of the pistons in the cylinder assembly 67. This rise in pressure will unseat the check valve 108 and fluid will now flow to the rotate-up side of the rotary fluid motor 89. The water inlet opening 45 and the impeller portion 47 will then rotate to an upwardly facing service position as shown in phantom in FIG. 2 and in solid lines in FIG. 5. Fluid is returned from the down side of the motor 89 by the opening of the line 106. The operation will continue until the fluid motor 89 reaches its stop, as aforenoted. At this time, there will be an abrupt pressure rise in the line 103 and the check valve 112 will open to relieve this pressure. As previously noted, opening of the check valve 112 will send an electrical control signal to the fluid circuit to shut off the electric motor driving the pump 92.

In this position, an operator can easily reach into the water inlet opening 45 of the jet propulsion unit through the gap 86 which now exists between the screen members 82 and remove foreign articles 88. To avoid pollution of the body of water in which the watercraft is operating, a bag hanger 118 is provided in the tunnel 42 adjacent the hatch opening 113 and supports a trash bag 119 which may be a porous bag. Hence, it is not necessary for these foreign materials to be placed into the interior of the watercraft 21 nor thrown back into the body of water in which the watercraft 21 is operating.

In addition to positioning jet propulsion unit 41 in the raised rotated position for servicing, the jet propulsion unit 41 may also be left in this position when the watercraft is not being operated. This will permit water to drain from the jet propulsion unit and also will remove the water inlet opening 45 from the body of water in which the watercraft 21 resides so as to avoid incrustation by barnacles or the like.

When it is desired to return the jet propulsion unit 41 to its lowered drive position, the respective switch 116 is again activated, still assuming that the kill switches 117 are in their "on" or "kill" positions. The switches 116 are being described as single acting switches that pushed once to tilt, rotate-up and again to tilt, rotate-down. Obviously, the switches 116 can be up/down switches that have a separate position for tilt-up than for tilt-down.

Once the tilt rotate-down operation is begun, the motor driving the pump 92 is operated in a direction so as to pressurize the port 93 and have the port 94 act as a return port. When this occurs, the line 95 will be pressurized and the check valve 99 will open under fluid pressure to pressurize the line 102. When this occurs, the pressure responsive valve 104 will preclude any flow to the tilt-down side of the fluid chamber 67 and fluid pressure will be exerted through the conduit 106 to the rotate-down side of the fluid motor 89. Again, for sealing purpose, it is desirable to have the jet propulsion 41 rotated downwardly before it is tilted downwardly. The fluid motor 89 rotates the water inlet portion 44 and impeller portion 47 from the up position to the down position wherein the rotary motor 89 reaches its stop.

During this rotary down motion, fluid is expelled from the down chamber of the rotary motor 89 past the light check valve 109 to the line 103. The check valve 101 is opened by the movement of the shuttle piston 98 to the right, and this fluid returns to the pump port 94 through the line 96.

Once the rotate-down position is reached, the pressure in the line 102 will raise sufficiently to unseat the pressure responsive valve 104 and the fluid motor 67 will be actuated in the tilt-down direction. Fluid is returned to the port 94 past the check valve 105, which opens at low pressure. This motion will occur until the seal engages between the water inlet opening 45 of the jet propulsion unit 41 and the plate 77, at which time the pressure in the line 103 will rise. This will open the relief valve 112 and activate the switch so as to shut off the motor driving the pump 92. The kill switch 117 can then be turned off to permit starting of the engine and driving of the watercraft.

Figure 11:
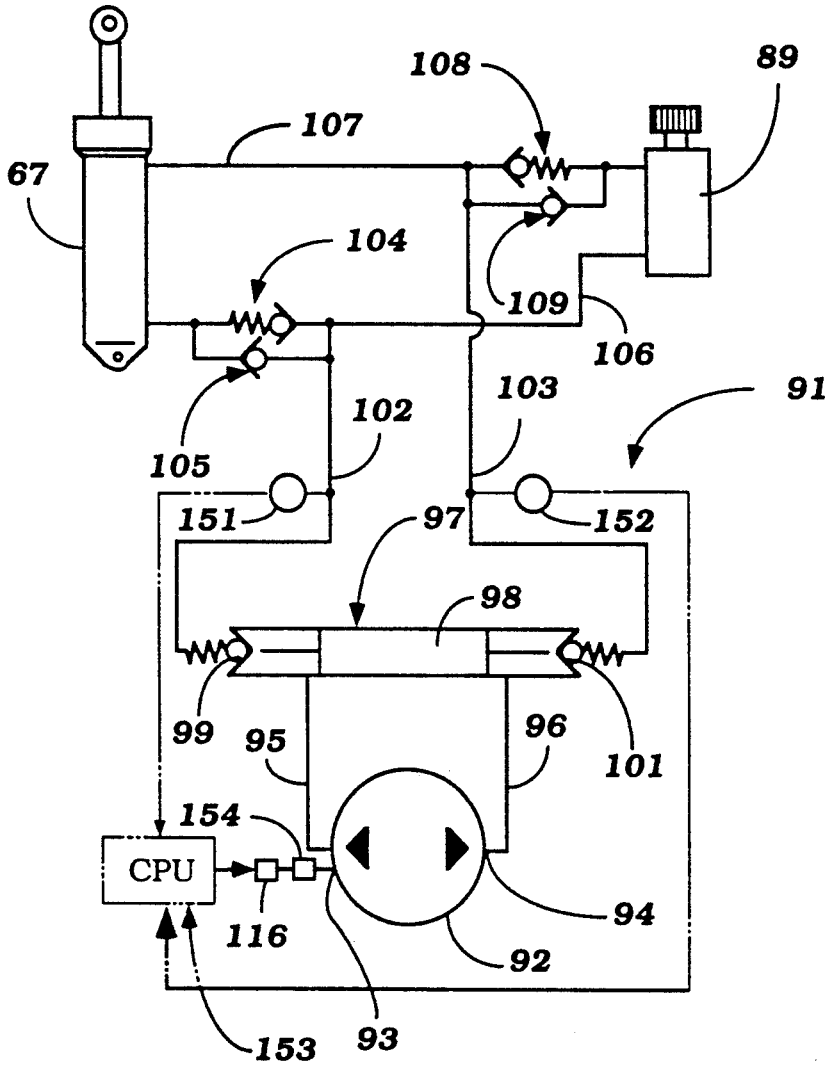
FIG. 11 is a schematic hydraulic circuit showing another embodiment of the invention.

In the embodiment of the invention as thus far described, the relief valves 111 and 112 have also operated electrical controls for shutting off the motor driving the pump 92. FIG. 11 shows another embodiment of the invention which is the same as the embodiment of FIG. 10 but which dispenses with the relief valves 111 and 112. For that reason, components of this embodiment which are the same as the previously described embodiment have been identified by the same reference numerals. In this embodiment, a pair of pressure responsive electrical devices 151 and 152 are placed in the lines 102 and 103 and which output signals to a CPU 153. The CPU 153 operates to change the condition of the switch 116 which, in turn, operates the electric motor driving the pump 92 through a relay 154. The CPU 153 is programmed so that when a pressure is indicated in either the line 102 or 103 which indicates that the tilt rotate-up or tilt rotate-down operations have been completed, the CPU 153 will disable the switch 116 and the unit will be stopped.

Figure 12:
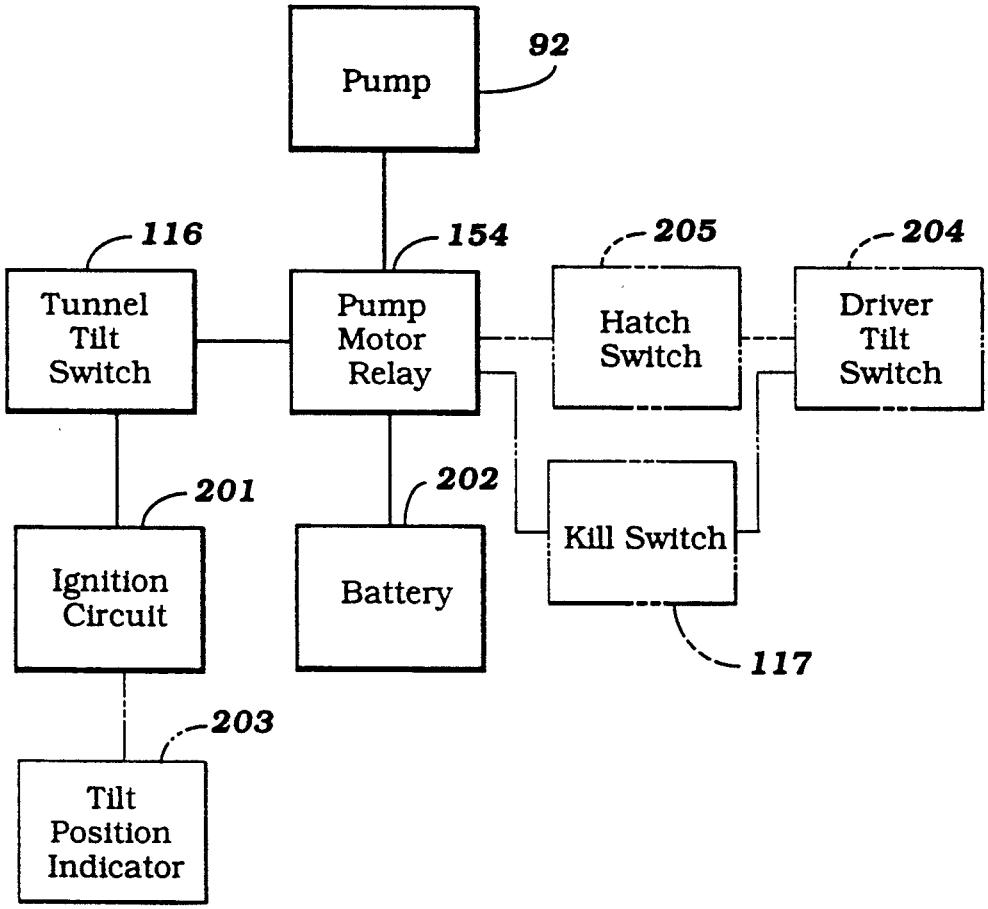
FIG. 12 is a partially schematic view showing how the various controls for the unit can be interrelated and alternative embodiments thereof.

FIG. 12 shows in solid lines another possible embodiment of the invention having the control circuit which prevents operation of the internal combustion engines 39 from driving the jet propulsion units 41 when the jet propulsion units 41 are not in their lowered driving positions. In this embodiment, an ignition circuit for the engine is identified generally by the reference numeral 201, as is a battery 202 for powering the circuitry. In this embodiment, the tilt switch 116 is interrelated with the engine ignition circuit 201 so that the ignition circuit itself is disable when the tunnel tilt switch 116 is operated. This can be done in any of a plurality of such ways such as by grounding the switching diode of an SCR type of ignition circuit. In this way, whenever the switch 116 is energized, the ignition circuit 201 will be de-energized. Hence, the necessity for the kill switch 117 in this embodiment can be deleted and only a single pair of switches 116 need be provided in the tunnel 42.

Rather than having the system disable by the operation of the tilt switches 116, there also can be provided a position sensing switch 203 which senses the tilt and rotational condition of the jet propulsion unit 41 so as to disable the ignition circuit 201 any time when the jet propulsion unit 41 is not in its driving position.

There may also be some desirability to provide a remote switch by which the driver may operate the tilt and rotational operation of the jet propulsion unit and such an arrangement is also shown in phantom in FIG. 12. This includes a remote driver's tilt switch 204 which is positioned in proximity to the steering wheel 25. For protection against injury, however, there is also provided a hatch switch 205 that determines the condition of the hatch cover 115 and which will not permit the driver's tilt switch 204 to operate the pump 92 except in conditions when the hatch 113 is covered. Alternatively, the driver's tilt switch 204 may be in circuit with the kill switch 117 so as to prevent the driver's operation of the hydraulic circuit for achieving the tilt and rotational operation unless the engine kill switch in on so that the engine 39 cannot be operated.

It should be readily apparent from the foregoing description that the described construction is very effective in providing an arrangement wherein foreign objects are easily screened from entry into the jet propulsion unit but wherein the jet propulsion unit can be readily serviced without removal of the screen. In addition, it is ensured that the unit cannot be driven when in a serviced position to avoid injury, an improved litter avoidance system is incorporated and also the liquid tank of the watercraft is well protected by the buoyant mass. Of course, the foregoing description is that of preferred embodiments of the invention and various changes and modifications may be made without departing from the spirit and scope of the invention, as defined by the appended claims.

I claim:

1. A jet propelled watercraft having a hull defining a water inlet, a jet propulsion unit having a portion forming a water inlet opening through which water is drawn for propelling said watercraft, means for supporting said water inlet opening forming portion for movement between a driving position and which said water inlet opening is in registry with said hull water inlet and a service position, a screen fixed contiguous to said jet propulsion unit water inlet opening at least when said water inlet opening is in its driving position, said hull opening, said screen and said water inlet opening cooperating for precluding the flow of water into said jet propulsion unit water inlet opening without passing through said screen when said water inlet opening is in its driving position to screen foreign objects from the water passing through said water inlet opening and for permitting said water inlet opening to be accessed without movement of said screen when said water inlet opening is in its service position.

2. A jet propelled watercraft as set forth in claim 1 wherein the screen is fixed to the jet propulsion unit water inlet opening forming portion and has a portion spaced from said water inlet opening through which an operator may place his hand when said jet propulsion unit water inlet opening forming portion is in its service position.

3. A jet propelled watercraft as set forth in claim 2 wherein the hull water inlet closes the gap through which the operator may place his hand when the jet propulsion unit is in its driving position.

4. A jet propelled watercraft as set forth in claim 3 wherein the hull defines a tunnel in which the jet propulsion unit is at least in part positioned and wherein the water inlet of the hull extends across the lower portion of the tunnel.

5. A jet propelled watercraft as set forth in claim 4 further including an access opening formed in the hull through which the tunnel may be reached and the jet propulsion unit water inlet opening may be accessed when in its service position.

6. A jet propelled watercraft as set forth in claim 5 wherein the movement of the water inlet opening forming portion is rotary movement about a generally longitudinally extending axis.

7. A jet propelled watercraft as set forth in claim 6 wherein the movement of the water inlet opening forming portion is also pivotal movement about a transversely extending horizontally disposed tilt axis.

8. A jet propelled watercraft as set forth in claim 6 further including means for precluding driving of the jet propulsion unit when the jet propulsion unit is not in its driving position.

9. A jet propelled watercraft as set forth in claim 8 wherein the watercraft further includes an internal combustion engine for driving the jet propulsion unit and the means for precluding driving of the jet propulsion unit when not in its driving position comprises means for disabling the internal combustion engine.

10. A jet propelled watercraft as set forth in claim 8 wherein the means for precluding driving of the jet propulsion unit comprises means for sensing when the jet propulsion unit is not in its driving position.

11. A jet propelled watercraft as set forth in claim 2 wherein the screen comprises a plurality of rod-shaped members affixed along one peripheral edge of the jet propulsion unit water inlet opening and extending transversely across the water inlet opening but spaced outwardly therefrom at their opposite ends.

12. A jet propelled watercraft as set forth in claim 11 wherein the movement of the water inlet opening forming portion is rotary movement about a generally longitudinally extending axis.

13. A jet propelled watercraft as set forth in claim 11 wherein the movement of the water inlet opening forming portion is tilt movement about a horizontally disposed transverse tilt axis.

14. A jet propelled watercraft as set forth in claim 13 wherein the water inlet opening forming portion is also rotatable about a longitudinally extending axis.

15. A jet propelled watercraft as set forth in claim 11 further including means for precluding driving of the jet propulsion unit when the jet propulsion unit is not in its driving position.

16. A jet propelled watercraft as set forth in claim 15 wherein the watercraft further includes an internal combustion engine for driving the jet propulsion unit and the means for precluding driving of the jet propulsion unit when not in its driving position comprises means for disabling the internal combustion engine.

17. A jet propelled watercraft as set forth in claim 15 wherein the means for precluding driving of the jet propulsion unit comprises means for sensing when the jet propulsion unit is not in its driving position.

18. A jet propelled watercraft as set forth in claim 5 further including means for supporting a litter bag within the tunnel for receiving foreign articles removed from the jet propulsion unit water inlet opening.

19. A jet propelled watercraft as set forth in claim 5 further including control means for controlling the movement of the jet propulsion unit and positioned within the tunnel.

20. A jet propelled watercraft as set forth in claim 19 further including means for supporting a litter bag within the tunnel for receiving foreign articles removed from the jet propulsion unit water inlet opening.

21. A jet propelled watercraft having a hull, an internal combustion engine supported within said hull, a jet propulsion unit having a portion forming a water inlet opening through which water is drawn for propelling said watercraft, means for supporting said water inlet opening forming portion for movement between a driving position in which water may be drawn into said water inlet opening and a service position, power means for moving said water inlet opening forming position between its positions, and means for precluding driving of said jet propulsion unit by said internal combustion engine when said portion of said jet propulsion unit forming said water inlet opening is not in its driving position.

22. A jet propelled watercraft as set forth in claim 21 wherein the movement of the portion of said jet propulsion unit forming the water inlet opening is rotary movement about a generally longitudinally extending axis.

23. A jet propelled watercraft as set forth in claim 21 wherein the movement of the water inlet opening forming portion is tile movement about a horizontally disposed transverse tilt axis.

24. A jet propelled as set forth in claim 23 wherein the portion of said jet propulsion unit forming the is also rotatable about a longitudinally extending axis.

25. A jet propelled watercraft as set forth in claim 21 wherein the means for precluding driving of the jet propulsion unit when not in its driving position comprises means for disabling the internal combustion engine.

26. A jet propelled watercraft as set forth in claim 21 wherein the means for precluding driving of the jet propulsion unit comprises means for sensing when the jet propulsion unit is not in its driving position.

27. A jet propelled watercraft as set forth in claim 21 wherein the hull is formed with a tunnel in which at least the portion of said jet propulsion unit forming the is positioned.

28. A jet propelled watercraft as set forth in claim 27 further including control means for the power means contained within the tunnel.

29. A jet propelled watercraft as set forth in claim 28 further including means for supporting a litter bag within the tunnel for receiving foreign articles removed from the jet propulsion unit water inlet opening.

30. A jet propelled watercraft as set forth in claim 27 further including a remote operator for operating the power means remotely from the tunnel.

31. A jet propelled watercraft as set forth in claim 30 further including a hatch cover for accessing the tunnel from within the hull and including interlock means for precluding operation of the power means from the remote operator when the hatch cover is opened.

32. A jet propelled watercraft as set forth in claim 30 further including means for operating the power means from within the tunnel.

33. A jet propelled watercraft as set forth in claim 32 further including a hatch cover for accessing the tunnel from within the hull and including interlock means for precluding operation of the power means from the remote operator when the hatch cover is opened.

34. A jet propelled watercraft having a hull defining a tunnel, a jet propulsion unit having a portion forming a water inlet opening through which water is drawn for propelling said watercraft, means for supporting said water inlet opening forming portion within said tunnel for movement between a driving position in which water may be drawn through said water inlet opening and a service position, an access opening in said hull through which said water inlet opening may be accessed when said water inlet opening forming portion is in its service position, and means for supporting a litter bag within said tunnel in proximity to said access opening.

35. A jet propelled watercraft as set forth in claim 34 further including power means for operating said water inlet opening forming portion between its driving and service positions and control means for said power means contained within said tunnel.

* * * * *